US010338517B2

(12) United States Patent
Hirasawa

(10) Patent No.: US 10,338,517 B2
(45) Date of Patent: Jul. 2, 2019

(54) WASTE LIQUID CONTAINER AND ATTACHMENT

(71) Applicant: SEIKO EPSON CORPORATION, Tokyo (JP)

(72) Inventor: Yusuke Hirasawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/847,453

(22) Filed: Dec. 19, 2017

(65) Prior Publication Data

US 2018/0203407 A1 Jul. 19, 2018

(30) Foreign Application Priority Data

Jan. 13, 2017 (JP) ..... 2017-003965

(51) Int. Cl.

| | |
|---|---|
| ***B41J 2/185*** | (2006.01) |
| ***G03G 21/12*** | (2006.01) |
| ***G03G 21/16*** | (2006.01) |

(52) U.S. Cl.

CPC ..... *G03G 21/1647* (2013.01); *B41J 2/185* (2013.01); *G03G 21/12* (2013.01); *B41J 2002/1856* (2013.01)

(58) Field of Classification Search

CPC .. B41J 2/1721; B41J 2/16523; B41J 2/17553; B41J 25/38; B41J 2002/1728; B41J 2002/1735; B41J 2002/1742; B41J 2002/1856

See application file for complete search history.

(56) References Cited

U.S. PATENT DOCUMENTS

| | | | | |
|---|---|---|---|---|
| 7,703,902 | B2 | 4/2010 | Nozawa et al. | |
| 7,976,121 | B2 * | 7/2011 | Harada | B41J 2/16523 347/31 |
| 8,651,638 | B2 * | 2/2014 | Ishikawa | B41J 2/175 215/232 |
| 2009/0219339 | A1 | 9/2009 | Harada | |
| 2010/0245468 | A1 | 9/2010 | Yamada | |
| 2012/0236074 | A1 | 9/2012 | Harada et al. | |

(Continued)

FOREIGN PATENT DOCUMENTS

| | | |
|---|---|---|
| EP | 2939837 | 11/2015 |
| JP | 2009-269203 | 11/2009 |
| JP | 2009-269209 A | 11/2009 |

(Continued)

OTHER PUBLICATIONS

European Search Report issued in Application No. 17208650 dated May 23, 2018.

*Primary Examiner* — Juanita D Jackson

(74) *Attorney, Agent, or Firm* — Workman Nydegger

(57) ABSTRACT

A waste liquid container includes a waste liquid vessel having a mounting face, a first side face, and a bottom face that are outer surfaces intersecting each other, a waste liquid inlet disposed on the mounting face, a circuit board having a connection terminal disposed along the first side face, and a first recess portion that opens in the mounting face and the bottom face below the waste liquid inlet. In the waste liquid container, when a width direction is defined as a direction in which both the mounting face and the bottom face extend, the first recess portion is disposed at a position between the waste liquid inlet and the connection terminal in the width direction.

13 Claims, 13 Drawing Sheets

(56) References Cited

U.S. PATENT DOCUMENTS

| | | | |
|---|---|---|---|
| 2015/0314605 | A1 | 11/2015 | Hirasawa et al. |
| 2017/0203575 | A1 | 7/2017 | Shimazu |

FOREIGN PATENT DOCUMENTS

| | | | |
|---|---|---|---|
| JP | 2012-196798 | A | 10/2012 |
| JP | 2015-208991 | A | 11/2015 |
| JP | 2017-124541 | A | 7/2017 |
| WO | 2006082836 | | 8/2006 |

* cited by examiner

WASTE LIQUID CONTAINER AND ATTACHMENT

BACKGROUND

1. Technical Field

The present invention relates to a waste liquid container and an attachment.

2. Related Art

An example of a waste liquid container is a waste liquid collector (for example, JP-A-2009-269209). The waste liquid collector includes a connection opening to be connected to a waste ink discharge outlet and a collector-side connection terminal to be connected to an apparatus-side connection terminal. The waste liquid collector is configured to receive waste ink discharged from a printer via the connection opening.

When waste ink that has dripped from the connection opening adheres to the collector-side connection terminal, electrical connectivity with the apparatus-side connection terminal may be hampered, leading to faulty connections.

SUMMARY

An advantage of some aspects of the invention is that a waste liquid container and an attachment that are less prone to faulty connections due to waste liquid adhesion are provided.

A waste liquid container according to an aspect of the invention includes a waste liquid vessel having a mounting face, a side face, and a bottom face that are outer surfaces intersecting each other, a waste liquid inlet disposed on the mounting face, a circuit board having a connection terminal disposed along the side face, and a recess portion that opens in the mounting face and the bottom face below the waste liquid inlet. In the waste liquid container, when a width direction is defined as a direction in which both the mounting face and the bottom face extend, the recess portion is disposed at a position between the waste liquid inlet and the connection terminal in the width direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of a waste liquid container and an attachment that can be mounted into a liquid ejecting apparatus will be described with reference to the drawings. An example of the liquid ejecting apparatus is an ink jet type printer that performs recording (i.e., printing) by ejecting ink, which is an example of a liquid, onto a medium, such as a sheet of paper. The waste liquid container is a container that can contain waste liquid discharged from the liquid ejecting apparatus.

Figure 1:
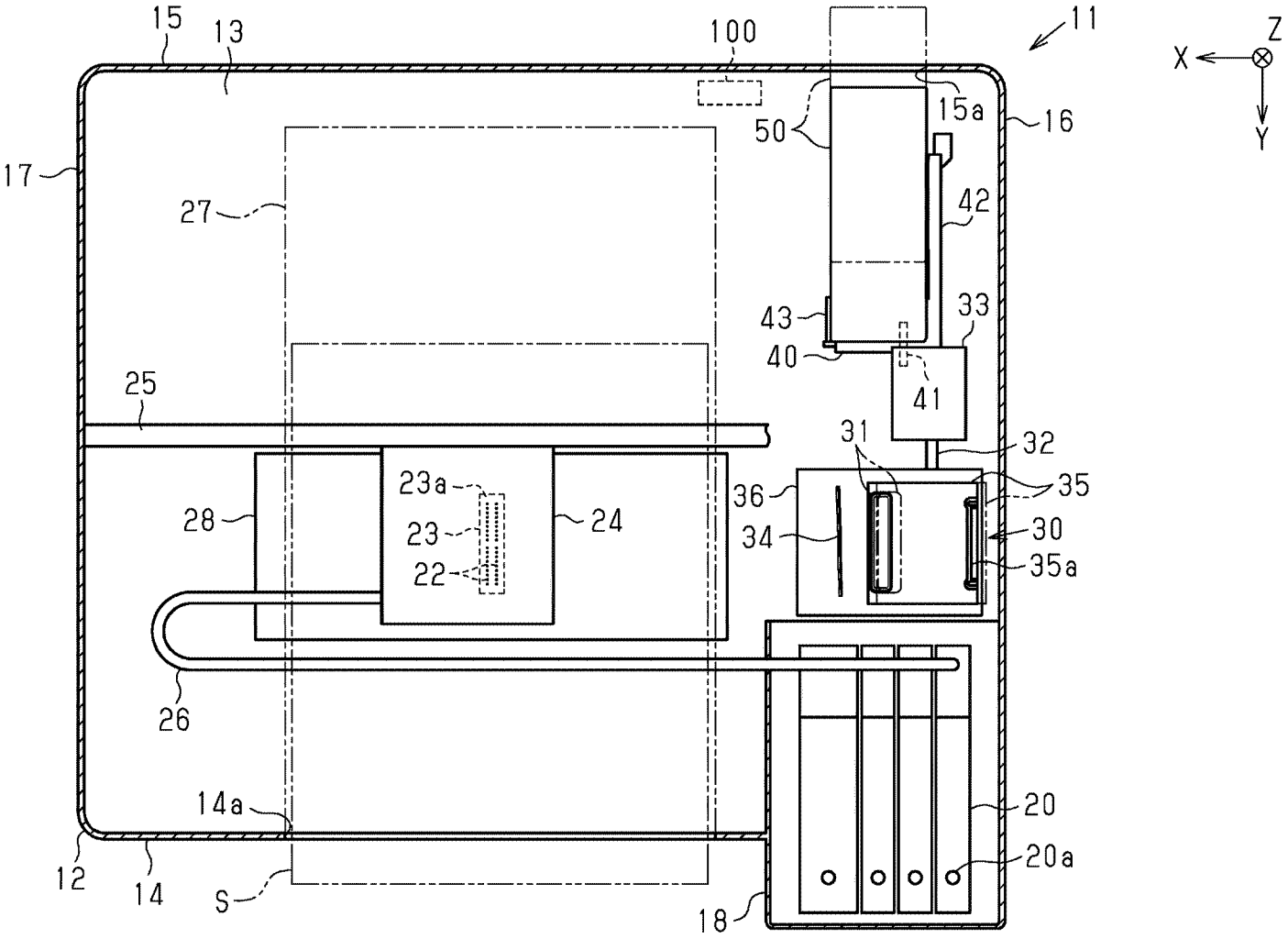
FIG. 1 is a view illustrating a general configuration of a liquid ejecting apparatus into which a waste liquid container is mounted.

As illustrated in FIG. 1, a liquid ejecting apparatus 11 includes a housing 12 that has a predetermined height, depth, and width when the liquid ejecting apparatus 11 is installed at a location for use. The housing 12 has a bottom wall 13, a front wall 14, and a rear wall 15, as well as side walls 16, 17 that extend in both the depth direction and the gravity direction.

In the present embodiment, the width direction and the depth direction extend substantially horizontally. The gravity direction is represented by the Z-axis, assuming that the housing 12 is placed on a horizontal surface. The Y-axis represents a direction (i.e., frontward direction) from the rear side of (or an area behind) the apparatus toward the front side of (or an area in front of) the apparatus. The X-axis that intersects the Y-axis and Z-axis represents the width direction. In other words, the width direction, the gravity direction, and the depth direction are directions intersect each other, and the X-axis, Y-axis, and Z-axis are coordinate axes used for indicating width, depth, and height, respectively.

In the housing 12, an accommodation section 18 is disposed in a region close to one end of the housing 12 in the width direction (i.e., a region close to the side wall 16, which is the side surface on the right-hand side of the apparatus, in FIG. 1). The accommodation section 18 protrudes frontward. In the embodiment, a side surface of the housing 12 at the one end of the housing 12 in the width direction is referred to as a "home side surface", and the side surface at the opposite end (i.e., the side wall 17) is referred to as a "counter-home side surface". In the accommodation section 18, a plurality of liquid containers 20 capable of containing liquid are disposed in a row in the width direction. A liquid container 20 has front and rear portions, and the front portion is positioned above the level of the rear portion as if to form stairs. The liquid container 20 may have an injection port 20*a* through which liquid can be injected. Injection can be facilitated by disposing the injection port 20*a* at a position in a portion of the liquid container 20 that protrudes outward from the front wall 14.

The housing 12 accommodates a liquid ejecting head 23, a carriage 24 that holds the liquid ejecting head 23, a guide shaft 25 that guides reciprocating movement of the carriage 24 in the width direction, a supply channel 26 that connects the carriage 24 to the liquid containers 20, a maintenance unit 30, a mounting unit 40, and a control unit 100. The liquid ejecting head 23 has a plurality of nozzles 22 and a nozzle-opening surface 23*a* on which the nozzles 22 open and is configured to eject liquid onto a medium S that is transported in a frontward direction. The control unit 100 controls liquid ejection of the liquid ejecting head 23 and maintenance of the maintenance unit 30.

Inside the housing 12, a transport path 27 for a medium S is formed in a middle portion in the width direction. On the transport path 27, a supporting platform 28 that can support a medium S is disposed in a region in which the liquid ejecting head 23 ejects liquid. A discharge opening 14*a* is formed in the front wall 14. Through the discharge opening 14*a*, a medium S on which printing has been performed is discharged from the housing 12.

The maintenance unit 30 is disposed closer than the supporting platform 28 to the home side surface. The accommodation section 18 is provided in front of the maintenance unit 30, and the mounting unit 40 is provided behind the maintenance unit 30.

The maintenance unit 30 includes a cap 31, a discharge channel 32 of which the upstream end is connected to the cap 31, a suction mechanism 33 disposed midway along the discharge channel 32, a wiping member 34 capable of wiping the nozzle-opening surface 23*a*, a slider 35 that holds the cap 31, and a support member 36. The suction mechanism 33 is formed so as to perform a suction operation for sucking the inside of the cap 31. The slider 35 is provided so as to move relative to the support member 36 that is disposed below the slider 35.

The slider 35 has an engagement projection 35*a* that projects upward at the end of the slider 35 that is close to the home side surface in the width direction. When the carriage 24 moves toward the home side surface and engages the engagement projection 35*a*, the slider 35 moves diagonally upward in accordance with further movement of the carriage 24, and the cap 31 is brought into contact with the liquid ejecting head 23 so as to form a closed space in which the nozzles 22 open. The operation whereby the cap 31 forms a closed space is called "capping". In FIG. 1, dash-dot-dot lines indicate the position of the cap 31 and the position of the slider 35 during capping. The inside of the liquid ejecting head 23 is sucked via the nozzles 22 by actuating the suction mechanism 33 during capping. The operation in which suction through the nozzles 22 causes the liquid ejecting head 23 to discharge the liquid therein in such a manner is called "suction cleaning".

A waste liquid container 50 is detachably mounted into the mounting unit 40. The waste liquid container 50 is a container capable of storing waste liquid (for example, waste ink) that is discharged in the suction operation. An insertion opening 15*a* opens in the rear wall 15. The waste liquid container 50 is inserted into the housing 12 through the insertion opening 15*a*. As illustrated with a dash-dot-dot line in FIG. 1, the waste liquid container 50 is inserted into the housing 12 and mounted into the mounting unit 40 by moving the waste liquid container 50 frontward from behind the housing 12.

The mounting unit 40 includes a waste liquid discharge outlet 41 to which the downstream end of the discharge channel 32 is connected, a holder 42 holding the waste liquid discharge outlet 41, and a circuit board connector 43 projecting rearward from the holder 42. The circuit board connector 43 is electrically coupled to the control unit 100.

Figure 2:
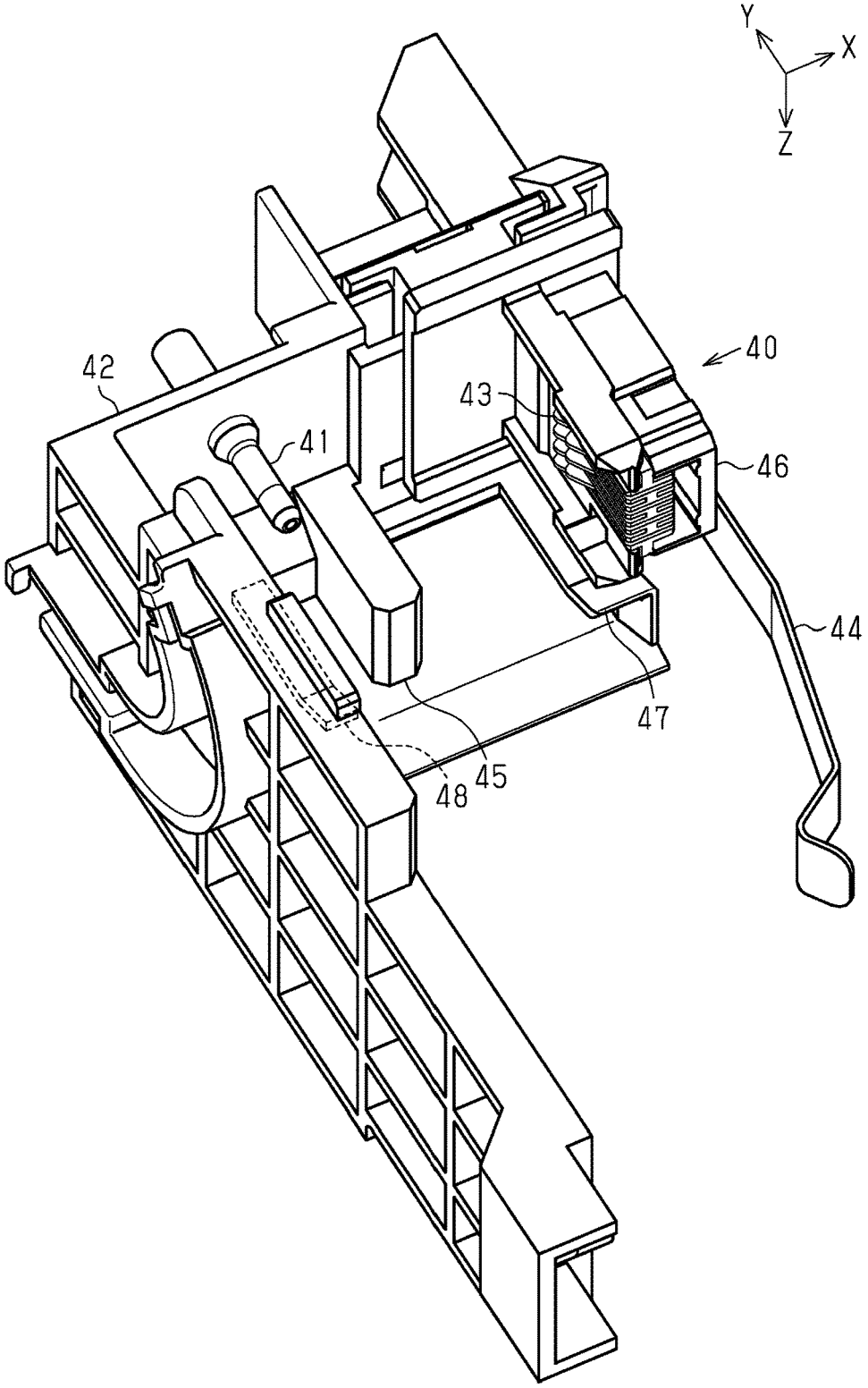
FIG. 2 is a cross-sectional view of a mounting unit included in the liquid ejecting apparatus in FIG. 1.

As illustrated in FIG. 2, the mounting unit 40 has a locking portion 44. The mounting unit 40 also has a first projection 45, a second projection 46, a third projection 47 and a fourth projection 48, all of which project rearward from the holder 42. The locking portion 44 is formed, for example, of a flat spring. The waste liquid discharge outlet 41 protrudes rearward at a position between the first projection 45 and the fourth projection 48 in the width direction.

The first projection 45 is positioned between the waste liquid discharge outlet 41 and the third projection 47 in the width direction. The second projection 46, which has the circuit board connector 43, is disposed above the level of the third projection 47. The circuit board connector 43 is held by the second projection 46 so as to face the waste liquid discharge outlet 41. The second projection 46 is disposed at a level substantially equal to the level of the waste liquid discharge outlet 41, whereas the first projection 45, the third projection 47, and the fourth projection 48 are disposed at levels below the second projection 46 and the waste liquid discharge outlet 41. The top end of the first projection 45 is positioned higher than the top ends of the third projection 47 and the fourth projection 48, which are positioned in two side regions with respect to the first projection 45, whereas the bottom end of the first projection 45 is lower than the bottom end of the third projection 47 and the bottom end of the fourth projection 48.

Figure 3:
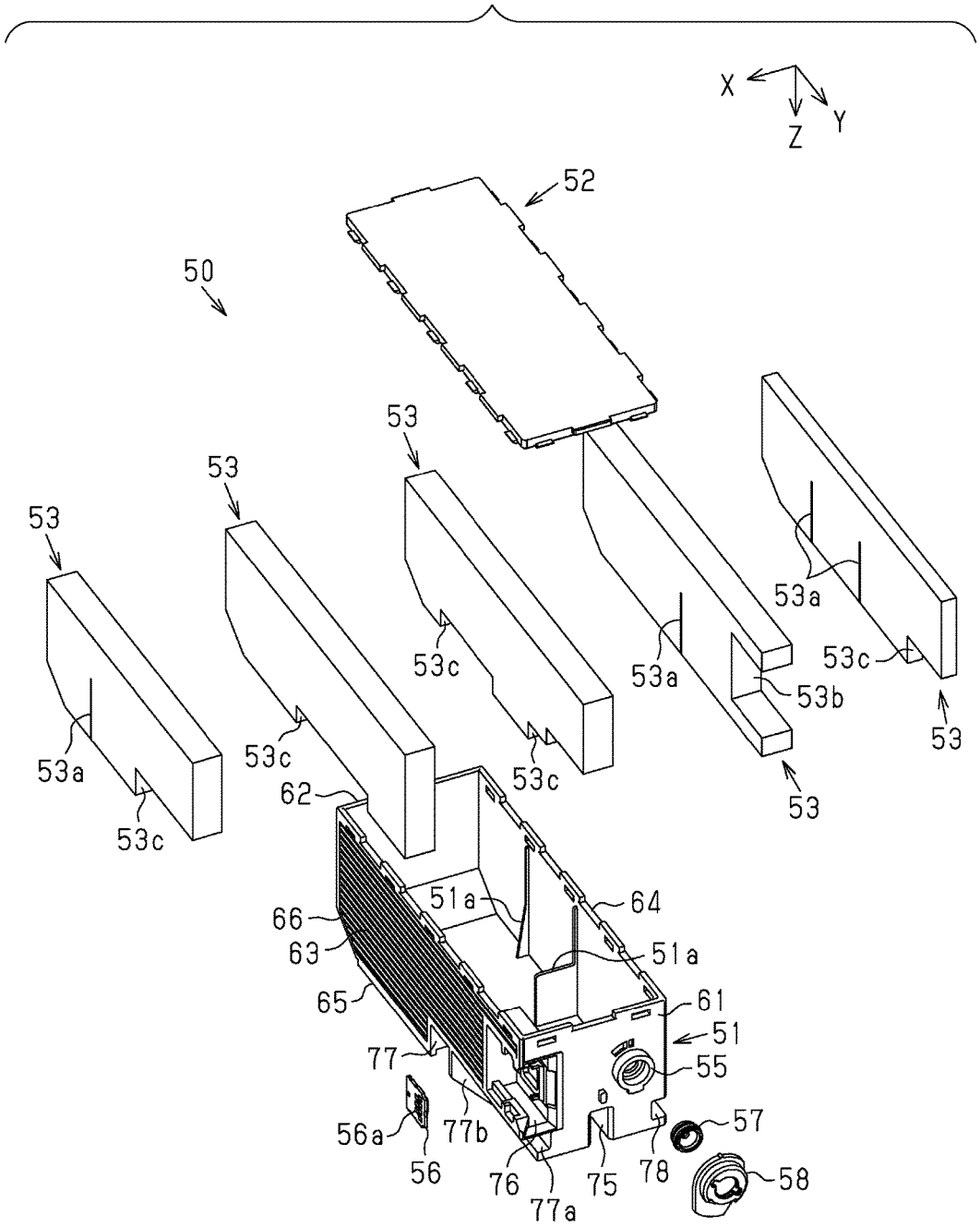
FIG. 3 is an exploded perspective view illustrating one embodiment of a waste liquid container.

Next, a structure of the waste liquid container 50 will be described in detail. As illustrated in FIG. 3, the waste liquid container 50 includes a waste liquid vessel 51 capable of storing waste liquid, a cover 52 that is mounted on the waste liquid vessel 51, a plurality of absorbers 53 capable of absorbing waste liquid stored in the waste liquid vessel 51, a waste liquid inlet 55, and a circuit board 56 having connection terminals 56*a*.

The circuit board 56 is, for example, an IC chip that is shaped like a thin plate and has a plurality of connection terminals 56*a* on one side thereof. The circuit board 56 has a memory unit that stores information about the waste liquid container 50.

A plurality of partitions 51*a* are erected inside the waste liquid vessel 51, and slits 53*a* to which the partitions 51*a* are inserted are formed in some of the absorbers 53. The partitions 51*a* prevent the absorbers 53 from moving within the waste liquid vessel 51. It is preferable that a first notch 53*b* be provided in a portion of an absorber 53 that is near the waste liquid inlet 55. The first notch 53*b* serves as an introduction space 59 (see FIG. 13) for introducing waste liquid.

Figure 4:
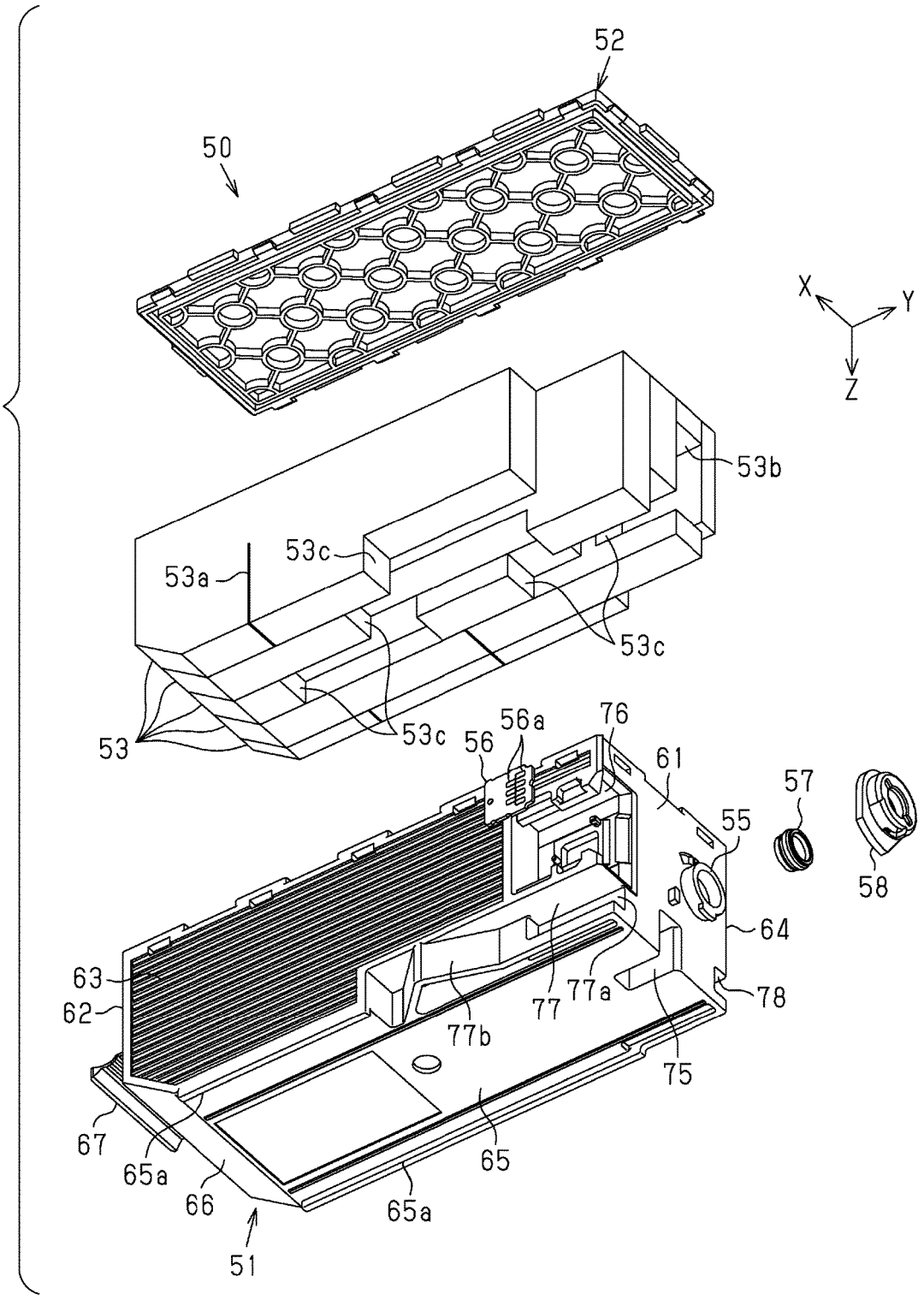
FIG. 4 is an exploded perspective view of the waste liquid container in FIG. 3.

As illustrated in FIG. 4, it is also preferable to provide a second notch 53*c* at the bottom of an absorber 53 so as to form a flow channel for enabling waste liquid to flow. It is further preferable that the flow channel be in communication with the space formed by the first notch 53*b*.

The waste liquid vessel 51 has a mounting face 61, a side face 63, and a bottom face 65, which are outer surfaces that intersect each other. When the side face 63 is referred to as a "first side face 63", an outer surface opposite to the first side face 63 is a second side face 64. Thus, the waste liquid vessel 51 also has the second side face 64, a front face 62 that is an outer surface opposite to the mounting face 61, and a chamfered face 66 that is an outer surface formed such that an edge of the waste liquid vessel 51 is chamfered. The chamfered face 66 intersects the bottom face 65, the first side face 63, the second side face 64, and the front face 62.

The waste liquid inlet 55 is disposed in the mounting face 61. It is preferable that an annular-shaped capping piece 58 be attached to the waste liquid inlet 55 with a sealing member 57 sandwiched therebetween. The waste liquid container 50 has a recess portion 75 that opens in the mounting face 61 and the bottom face 65 at a level below the waste liquid inlet 55.

Figure 5:
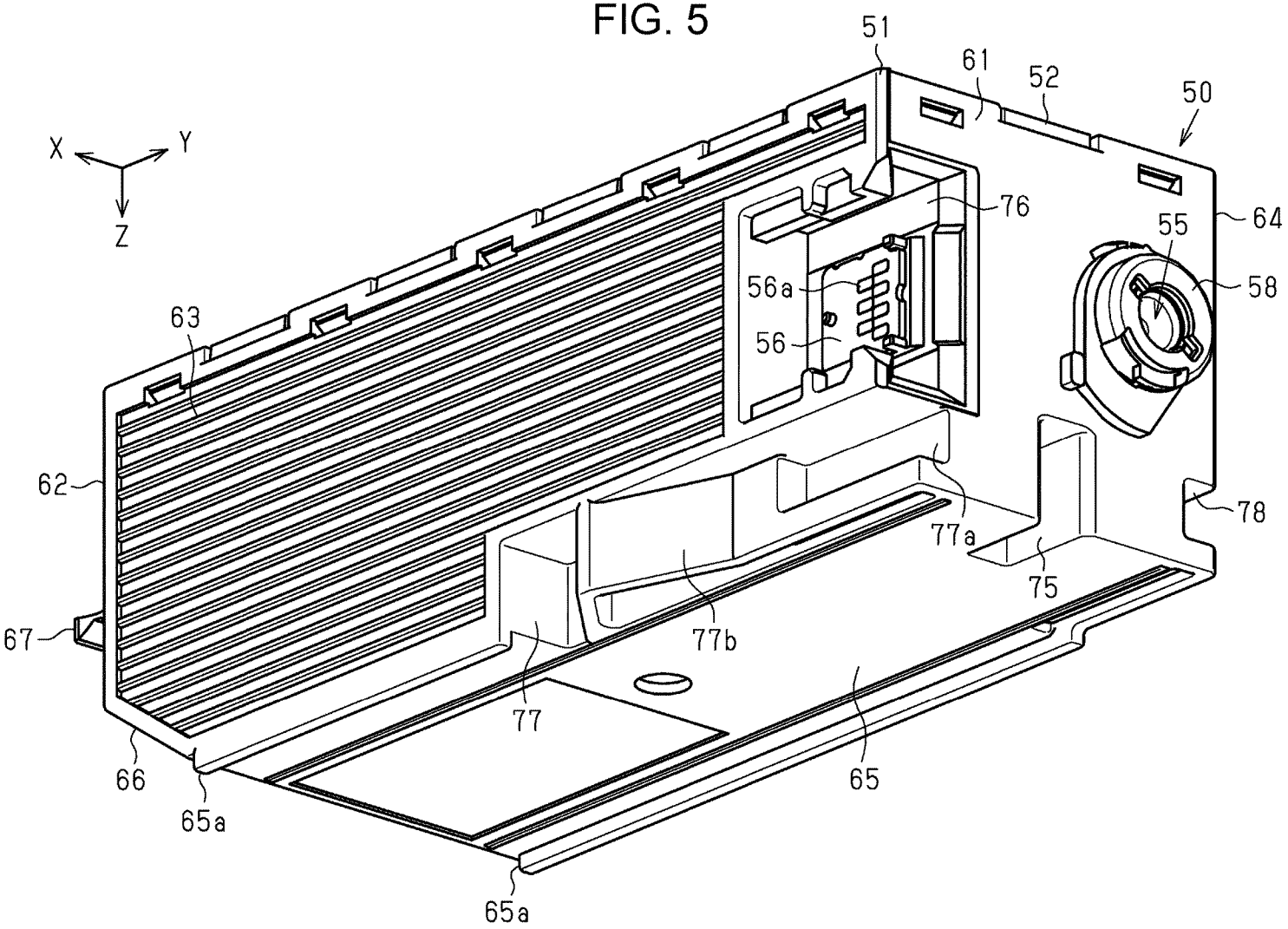
FIG. 5 is a perspective view of the waste liquid container in FIG. 3.

As illustrated in FIG. 5, the recess portion 75 is disposed between the waste liquid inlet 55 and the connection terminals 56*a* in the width direction in which both of the mounting face 61 and the bottom face 65 extend (i.e., in the X direction). It is preferable that the recess portion 75 extend so as to have a predetermined length in a moving direction of the waste liquid container 50 that intersects the mounting face 61 (i.e., in the Y direction).

When the recess portion 75 is referred to as a "first recess portion 75", the waste liquid container 50 preferably has a second recess portion 76 that opens in the mounting face 61 and in the first side face 63. In this case, it is preferable to dispose the circuit board 56 inside the second recess portion 76. In addition, the circuit board 56 is preferably installed inside the second recess portion 76 such that the connection terminals 56*a* face outward in the width direction.

It is also preferable that the waste liquid container 50 include a third recess portion 77 that opens in the mounting face 61 and the first side face 63 at a level below the second recess portion 76. It is preferable that the third recess portion 77 have an engagement recess portion 77*a* and an engagement convex portion 77*b* disposed therein, and that inside the third recess portion 77, the engagement recess portion 77*a* be positioned near the mounting face 61 and the engagement convex portion 77*b* be positioned closer than the engagement recess portion 77*a* to the front face 62. Moreover, the waste liquid container 50 preferably has a fourth recess portion 78 that is a dent opening in the mounting face 61 and the second side face 64 at a level below the waste liquid inlet 55.

Figure 6:
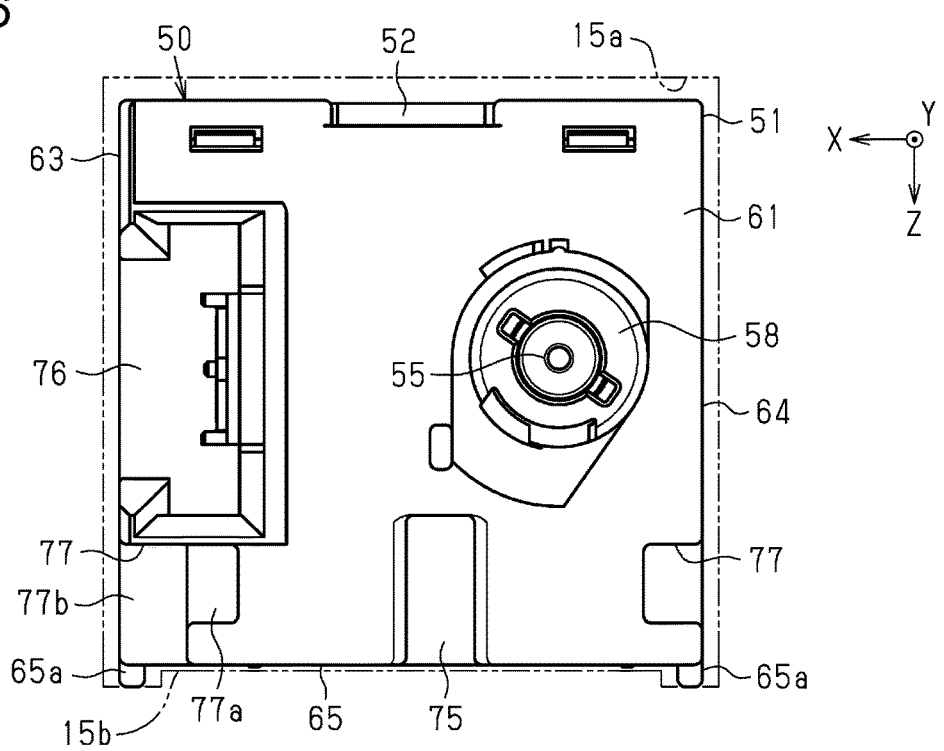
FIG. 6 is a front view of the waste liquid container in FIG. 3.
Figure 7:
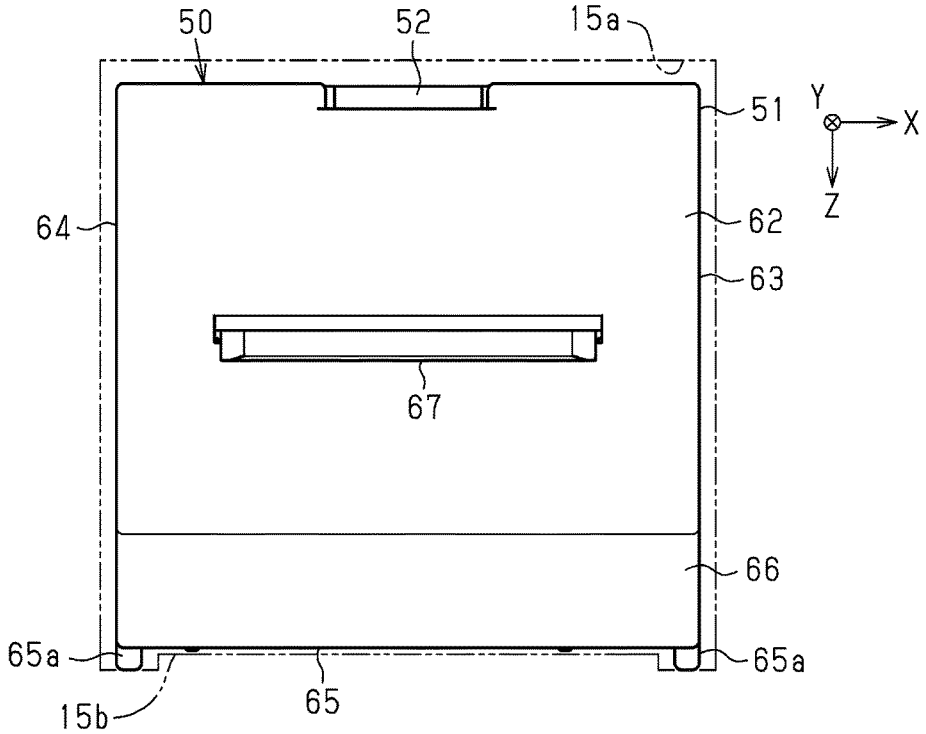
FIG. 7 is a rear view of the waste liquid container in FIG. 3.
Figure 8:
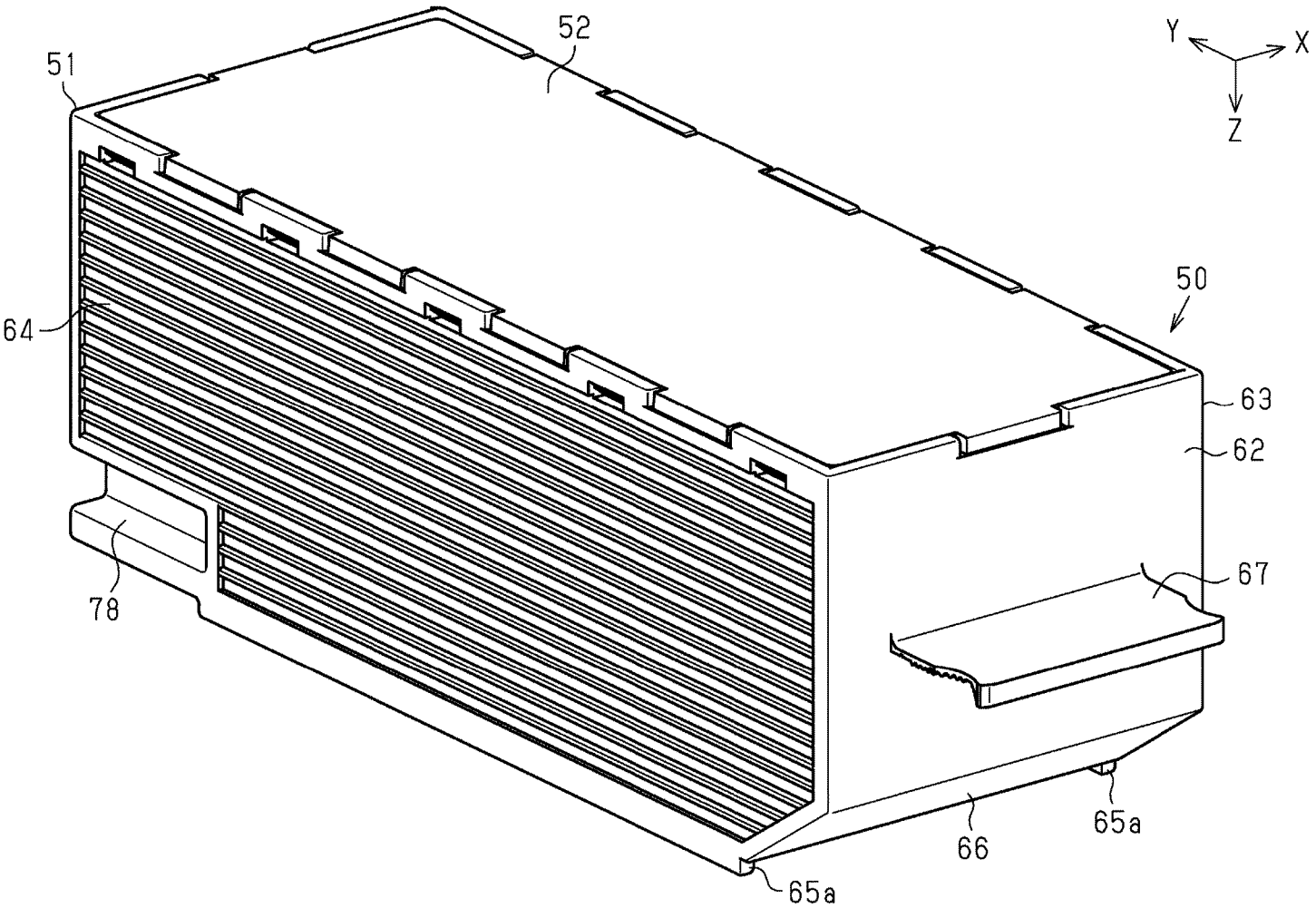
FIG. 8 is a perspective view of the waste liquid container in FIG. 3.
Figure 9:
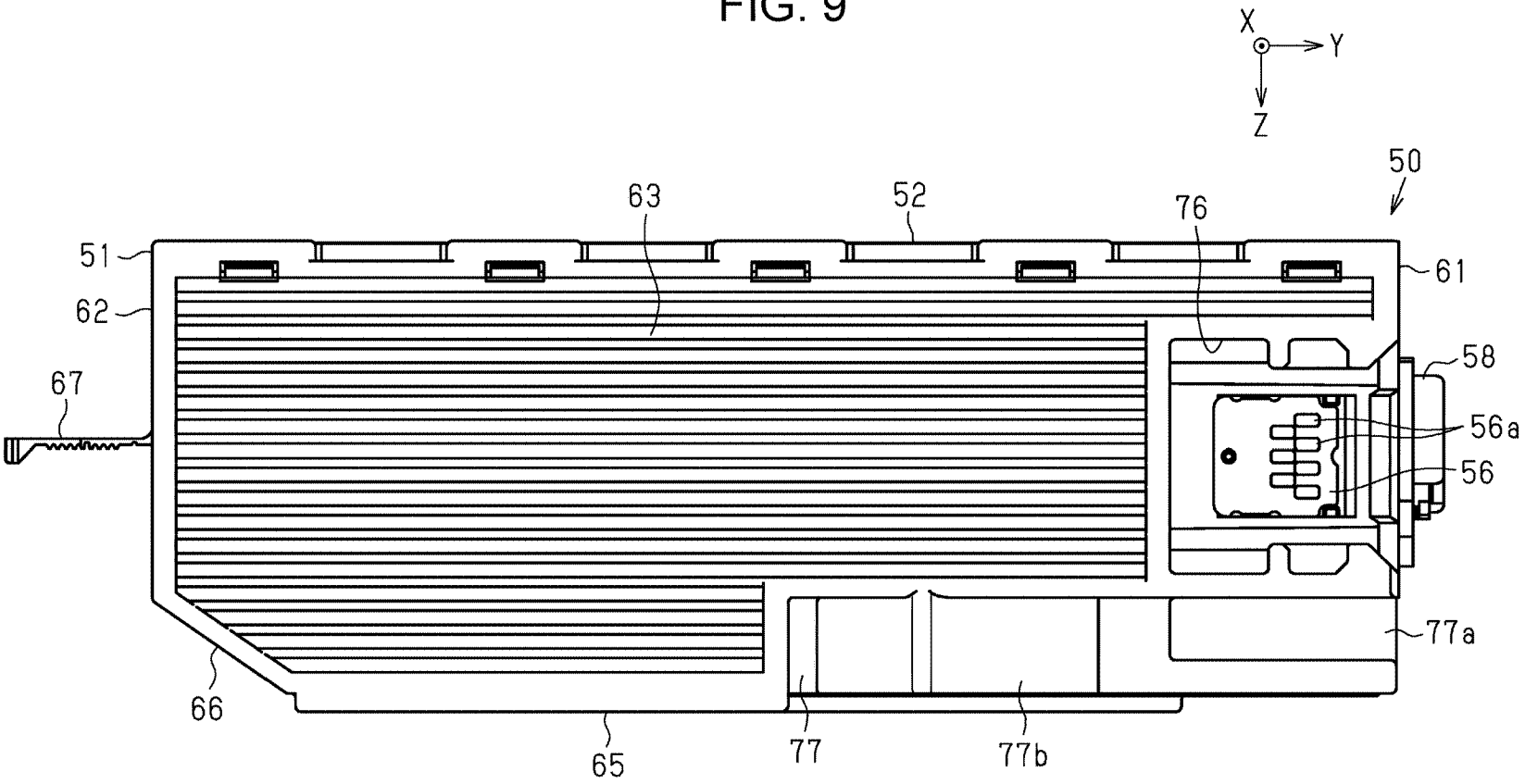
FIG. 9 is a left side view of the waste liquid container in FIG. 3.
Figure 10:
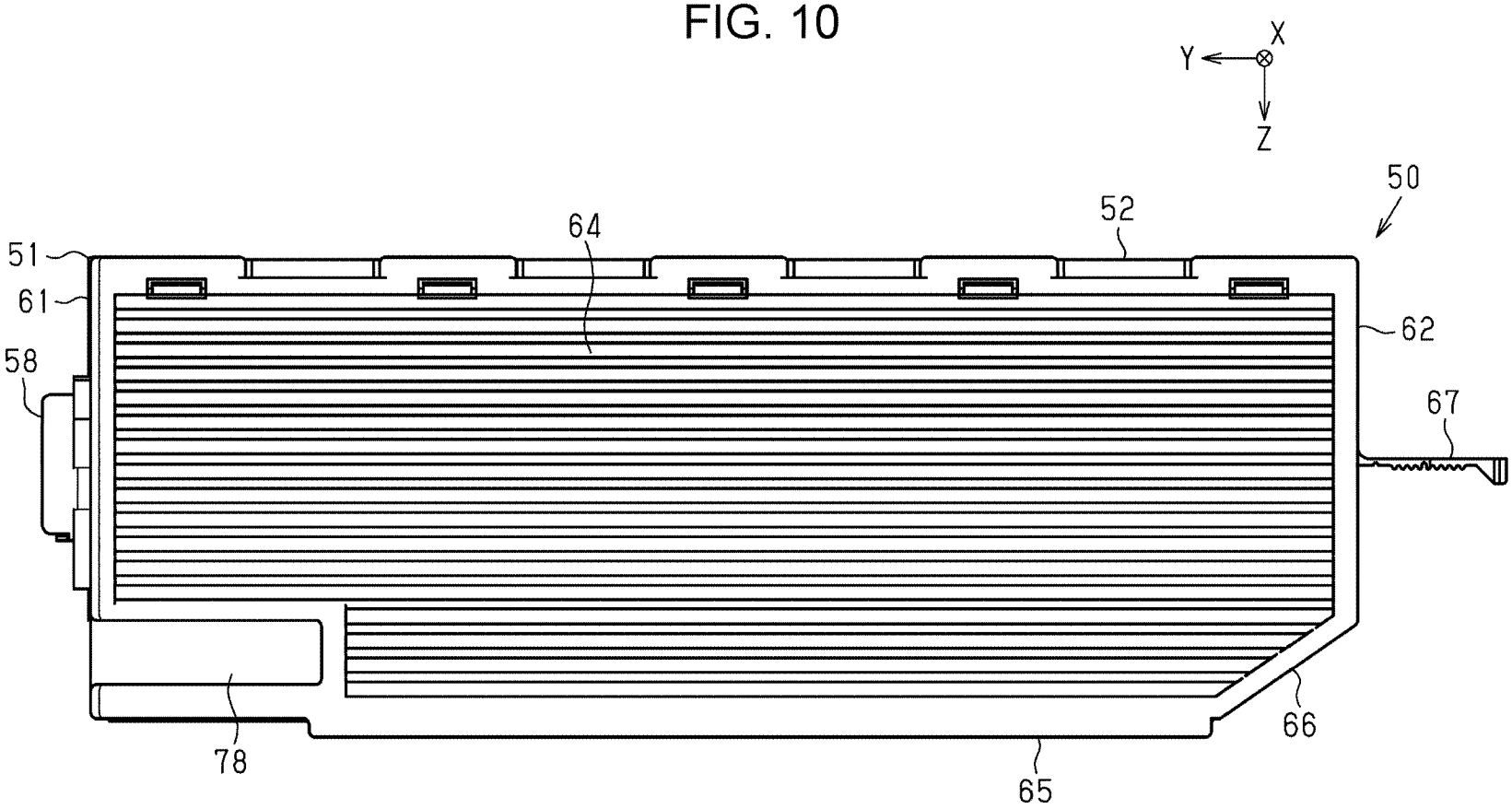
FIG. 10 is a right side view of the waste liquid container in FIG. 3.

As illustrated in FIG. 6, the movement of the waste liquid container 50 can be guided while mounting or unmounting the waste liquid container 50 by providing a pair of projections 65*a*, which are shaped like rails, on the bottom face 65 of the waste liquid container 50 and also providing, at the insertion opening 15*a*, an engagement convex portion 15*b* that engages the projections 65*a*. This can reduce the likelihood of the waste liquid container 50 being mounted upside down by mistake.

As illustrated in FIGS. 7 to 10, the waste liquid container 50 preferably has a grip 67 disposed on the front face 62. In particular, forming the grip 67 so as to protrude from the front face 62 makes it easier for a user to grip the grip 67 when detaching the waste liquid container 50 from the mounting unit 40. In addition, forming the grip 67 so as to be folded along the front face 62 enables the grip 67 to be stored neatly.

Figure 11:
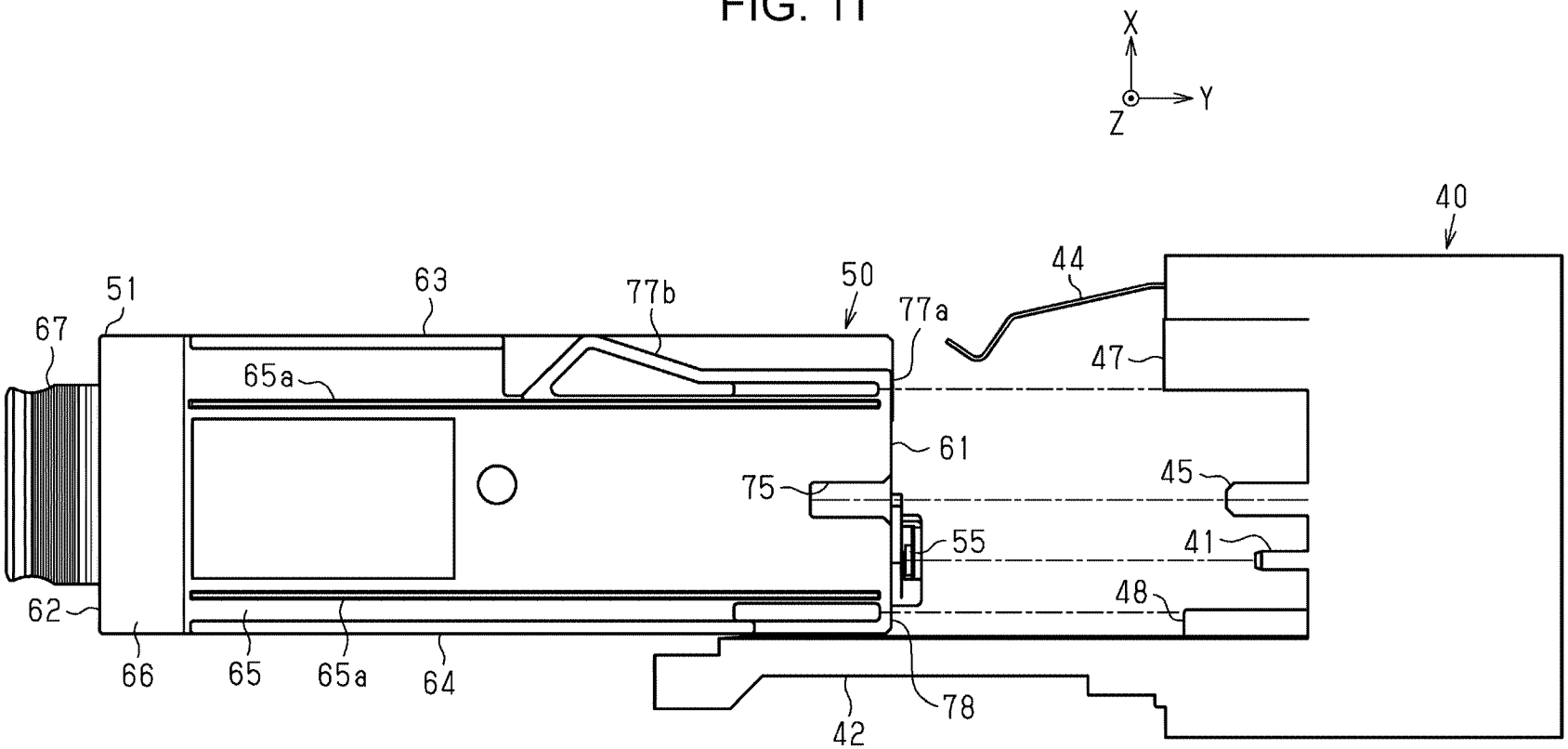
FIG. 11 is a bottom view illustrating a state in which the waste liquid container in FIG. 3 is being mounted into the mounting unit in FIG. 2.
Figure 12:
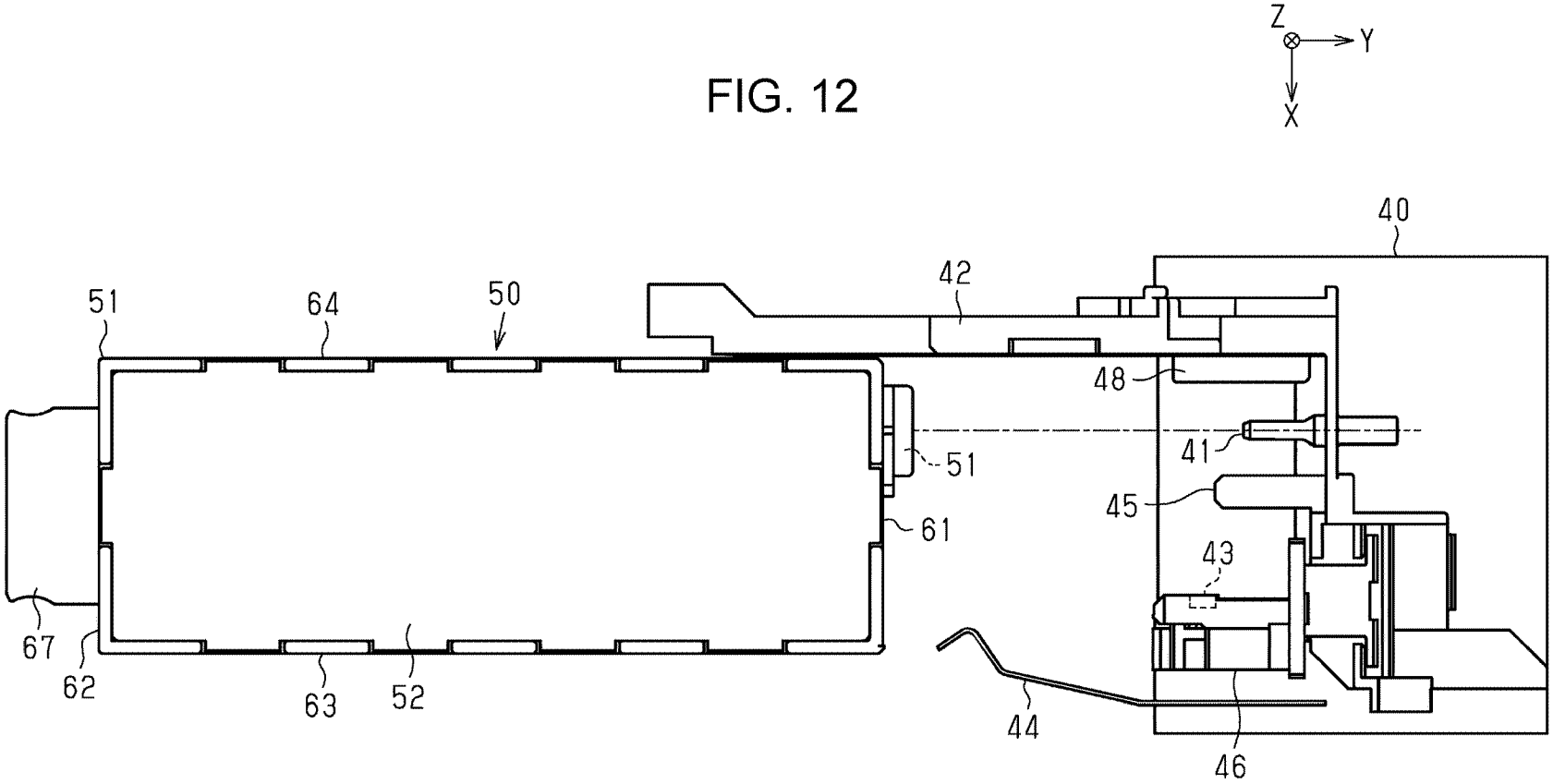
FIG. 12 is a plan view illustrating the state in which the waste liquid container in FIG. 3 is being mounted into the mounting unit in FIG. 2.

Next, operational advantages of the waste liquid container 50 configured as above will be described. As illustrated in FIGS. 11 and 12, the waste liquid container 50 is detachably mounted into the mounting unit 40 while the waste liquid container 50 is moved in the moving direction (in the Y direction) that intersects the mounting face 61.

For example, when mounting the waste liquid container 50 in the mounting unit 40, the waste liquid container 50 is moved to the mounting unit 40. At this time, as the waste liquid container 50 approaches the holder 42, the first projection 45 is inserted into the first recess portion 75 that comes near the bottom of the waste liquid container 50, which positions the waste liquid container 50 in the width direction. Subsequently, the waste liquid discharge outlet 41 is connected to the waste liquid inlet 55 of the waste liquid container 50 that has been positioned as above. Meanwhile, the second projection 46 that projects from the holder 42 is inserted into the second recess portion 76 so that the connection terminals 56*a* disposed inside the second recess portion 76 are brought into contact with the circuit board connector 43. Moreover, the locking portion 44 engages the engagement convex portion 77*b* of the waste liquid container 50, thereby restraining the waste liquid container 50 from moving rearward. Consequently, mounting of the waste liquid container 50 into the mounting unit 40 is completed.

When the waste liquid container 50 is mounted into the mounting unit 40, the third projection 47 and the fourth projection 48 are inserted respectively into the engagement recess portion 77*a* and the fourth recess portion 78, which are located at opposing ends of the waste liquid container 50 in the width direction. This restrains the waste liquid container 50 from rotating about the waste liquid inlet 55. Thus, an appropriate connection between the connection terminals 56*a* and the circuit board connector 43 is maintained. When the connection terminals 56*a* are connected to the circuit board connector 43, data such as information stored in the memory unit of the circuit board 56 is transferred to the control unit 100 via the circuit board connector 43.

Figure 13:
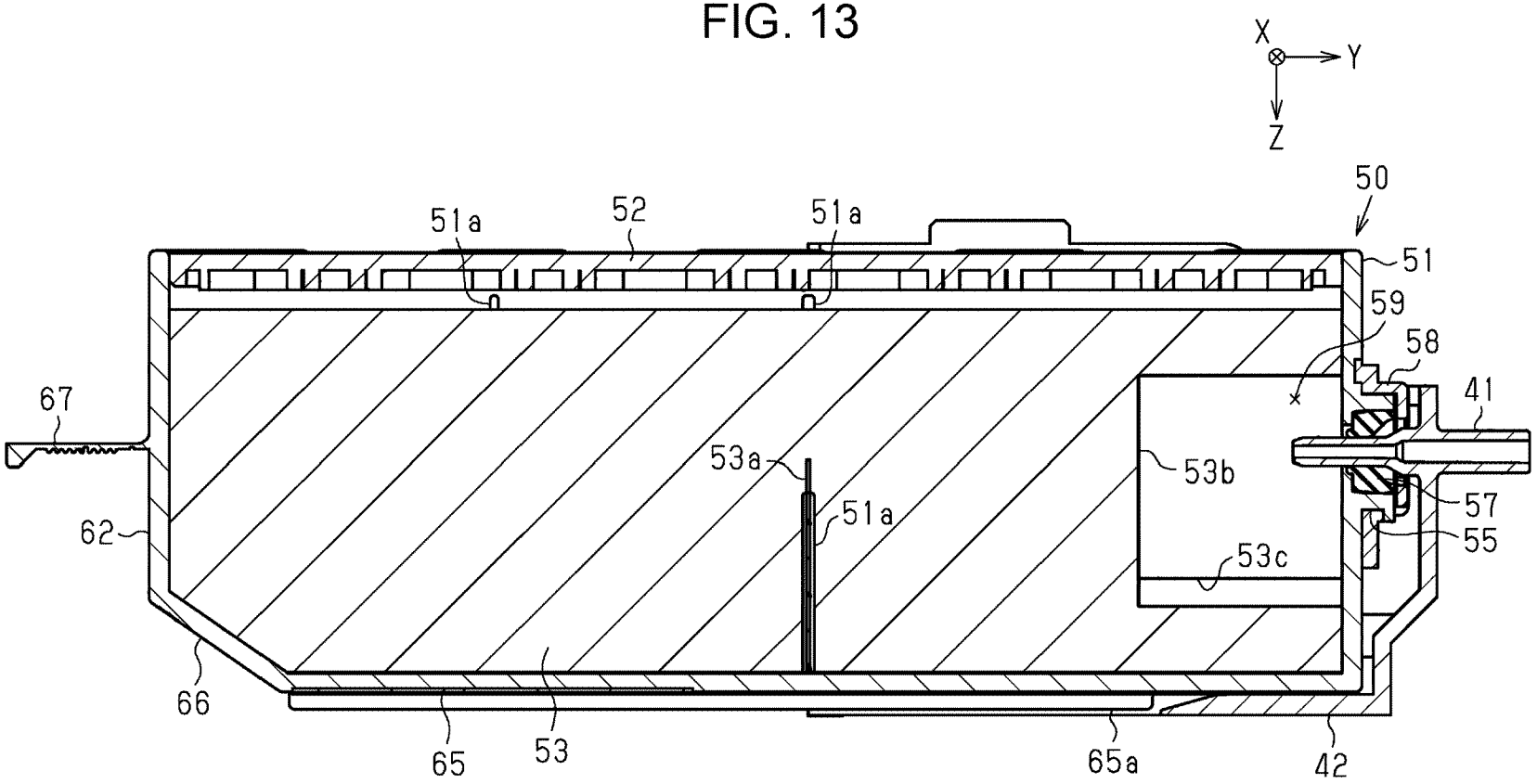
FIG. 13 is a cross-sectional view illustrating a state in which the waste liquid container in FIG. 3 has been mounted into the mounting unit in FIG. 2.

As illustrated in FIG. 13, when the waste liquid container 50 is mounted into the mounting unit 40, the waste liquid discharge outlet 41 is inserted into the waste liquid vessel 51 through the waste liquid inlet 55. At this time, the tip of the waste liquid discharge outlet 41 is positioned in the introduction space 59 formed by the first notch 53*b* of the absorber 53. Thus, waste liquid that is discharged from the liquid ejecting apparatus 11 by the suction operation, such as suction cleaning, is introduced via the waste liquid discharge outlet 41 into the introduction space 59. The waste liquid flows along the bottom inner surface of the waste liquid vessel 51 through the channels (formed by the second notches 53*c*) that are in communication with the introduction space 59. The waste liquid is consequently absorbed by the absorbers 53.

The waste liquid container 50, which is mounted into the mounting unit 40, is detached from the mounting unit 40 while the waste liquid container 50 is moved rearward. In an event such as the waste liquid container 50 being mounted into, or detached from, the mounting unit 40, waste liquid may leak from the waste liquid discharge outlet 41 or the waste liquid inlet 55. If the waste liquid that has leaked adheres to the connection terminals 56*a* or the circuit board connector 43, a faulty connection may occur between the connection terminals 56*a* and the circuit board connector 43, which may impede information transfer.

However, in the waste liquid container 50 according to the embodiment, waste liquid leaking from the waste liquid inlet 55 flows along the mounting face 61 toward the bottom face 65. The waste liquid subsequently flows in the width direction along the bottom face 65 and finally accumulates in the first recess portion 75 that opens in the bottom face 65. Thus, waste liquid does not easily flow toward the first side face 63 and the second side face 64.

Even if waste liquid, which has flowed along the bottom face 65, reaches the first side face 63 or the second side face 64, the waste liquid enters the third recess portion 77 or the fourth recess portion 78 and does not easily move upward therefrom. When the waste liquid container 50 is mounted into the mounting unit 40, waste liquid does not easily adhere to the circuit board 56 and the circuit board connector 43 because both are accommodated in the second recess portion 76 that is located above the level of the third recess portion 77.

In addition, in the second recess portion 76, the circuit board 56 is disposed such that the connection terminals 56*a* face outward in the width direction. Thus, waste liquid does not easily adhere to the connection terminals 56*a* compared with the case in which the connection terminals 56*a* face the mounting face 61.

The first recess portion 75 has a predetermined length in the movement direction of the waste liquid container 50. Thus, even if waste liquid drops from the stylus-shaped waste liquid discharge outlet 41 that protrudes from the holder 42, the first recess portion 75 can contain the waste liquid. Note that a space is formed by the chamfered face 66 at the rear bottom of the waste liquid container 50. Thus, even if waste liquid flows along the bottom face 65 toward the front face 62, the waste liquid can be stored in the space. As a result, the waste liquid does not easily adhere to the grip 67 that is positioned above the chamfered face 66. Thus, when a user grips the grip 67 to mount/unmount the waste liquid container 50, the user does not easily get waste liquid their hand.

The embodiment may be modified into modification examples below. Elements included in the embodiment can be arbitrarily combined with elements included in any one of the modification examples described below. Moreover, the elements included in the modification examples can be arbitrarily combined with each other. Note that in the description below, the same reference numeral is given to an element having a function similar to that of an element previously described, and therefore, duplicated description thereof is omitted.

The waste liquid container 50 can be changed to an attachment that can be detachably mounted into the mounting unit 40. The attachment, which has an external shape similar to the waste liquid container 50, may be mounted into the mounting unit 40 in a manner to be exchangeable with the waste liquid container 50. Alternatively, the attachment may be mounted into a mounting unit that is different from the one used for the waste liquid container 50 and separately disposed in the liquid ejecting apparatus 11.

Figure 14:
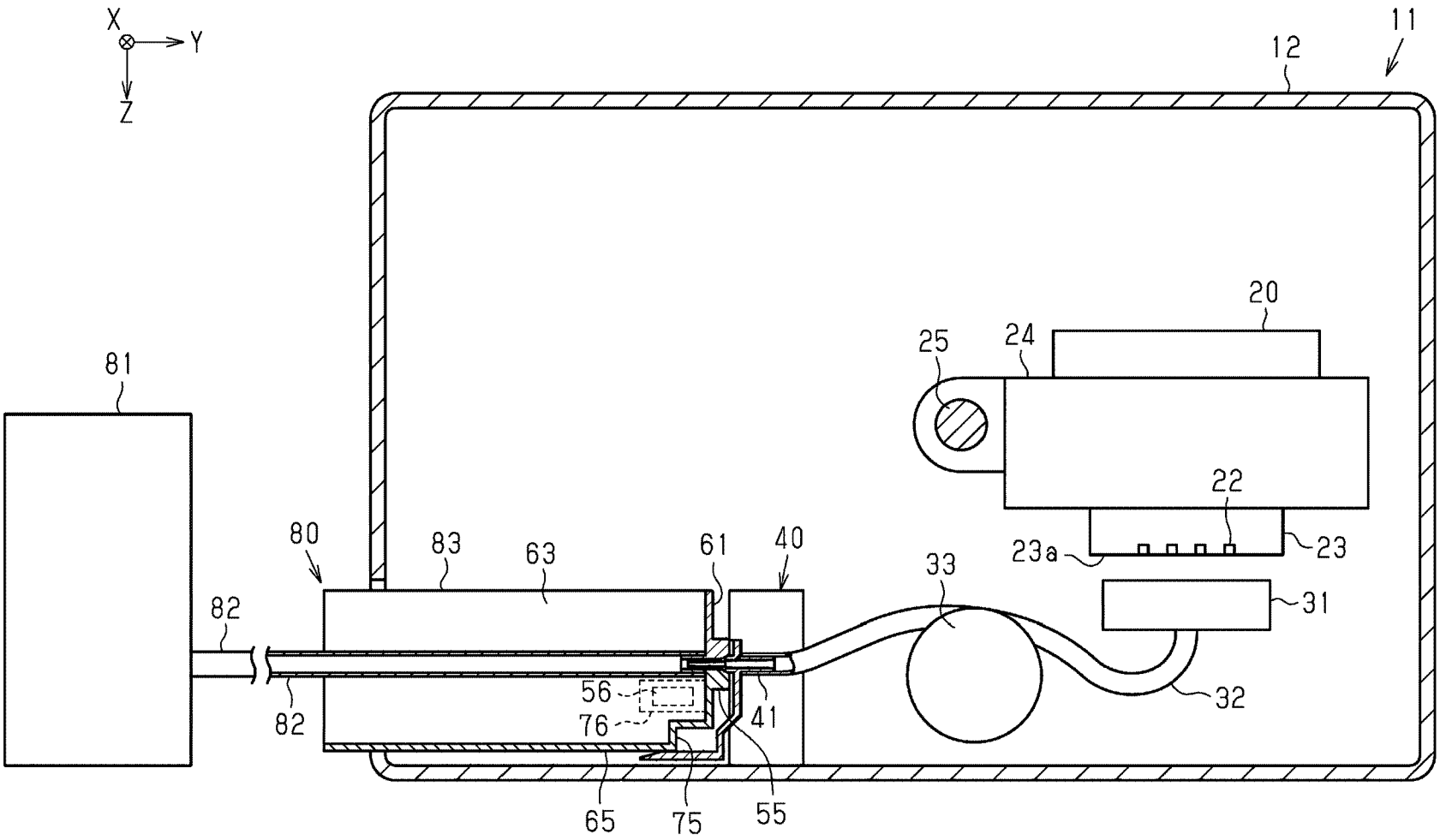
FIG. 14 is a cross-sectional view illustrating one embodiment of an attachment.

For example, as illustrated in FIG. 14, an attachment 80 that is connected to a waste liquid tank 81 via a waste liquid tube 82 is mounted into the mounting unit 40 of the liquid ejecting apparatus 11. The attachment 80 includes, in place of the waste liquid vessel 51, a frame body 83 that has at least the mounting face 61, the side face 63, and the bottom face 65, which are outer surfaces that intersect each other. The attachment 80 also includes the waste liquid inlet 55 that is connected to the waste liquid tube 82. The frame body 83 need not include an absorber 53. In this case, waste liquid that is discharged by the suction operation in the liquid ejecting apparatus 11 is received in the waste liquid tank 81 via the waste liquid tube 82 connected to the attachment 80.

As in the modification example illustrated in FIG. 14, the liquid containers 20 can be held by the carriage 24. The liquid that the liquid ejecting head 23 ejects is not limited to ink, but may be, for example, a liquid-state material made by dispersing or mixing particles of a functioning material in liquid. For example, the liquid ejecting head 23 may be configured so as to perform recording by ejecting a liquid-state material that contains, in the form of a dispersion or melt, an electrode material, a coloring material (pixel material), etc., to be used for manufacturing liquid crystal displays, Electro Luminescence (EL) displays, surface light emission displays, etc.

The medium S is not limited to a sheet of paper but may be a plastic film, a thin board material, etc., or may be a piece of cloth to be used for a cloth-printing apparatus, etc. Moreover, the medium S may be an arbitrarily-shaped piece of clothing or the like, such as a T-shirt, or may be an arbitrarily-shaped three-dimensional object, such as a piece of tableware or stationery.

Technical ideas involved in the embodiment and modification examples as well as advantageous effects thereof are as follows.

Technical Idea 1: a waste liquid container including a waste liquid vessel having a mounting face, a side face, and a bottom face that are outer surfaces intersecting each other, a waste liquid inlet disposed on the mounting face, a circuit board having a connection terminal disposed along the side face, and a recess portion that opens in the mounting face and the bottom face below the waste liquid inlet, wherein when a width direction is defined as a direction in which both the mounting face and the bottom face extend, the recess portion is disposed at a position between the waste liquid inlet and the connection terminal in the width direction.

With this configuration, even if waste liquid that has leaked from the waste liquid inlet flows along the mounting face toward the bottom face, the waste liquid stays within the recess portion and does not easily flow toward the connection terminal. Thus, faulty connections due to waste liquid adhesion to the connection terminal does not tend to occur.

Technical Idea 2: the waste liquid container according to Technical Idea 1, further including, when the recess portion is a first recess portion, a second recess portion that opens in the mounting face and the side face, wherein the circuit board is disposed inside the second recess portion.

According to this configuration, the second recess portion that accommodates the connection terminal does not open in the bottom face. As a result, the waste liquid that has flowed toward the bottom face does not easily enter the second recess portion. This reduces the likelihood of waste liquid adhering to the connection terminal disposed inside the second recess portion.

Technical Idea 3: the waste liquid container according to Technical Idea 2, wherein the circuit board is disposed inside the second recess portion in such a manner that the connection terminal faces outward in the width direction.

According to this configuration, the connection terminal faces outward in the width direction so that waste liquid does not easily adhere to the connection terminal compared with the case in which the connection terminal faces toward the mounting face.

Technical Idea 4: the waste liquid container according to Technical Idea 2 or 3, further including a third recess portion that opens in the mounting face and the side face below the second recess portion.

According to this configuration, the third recess portion is positioned closer to the bottom face than the second recess portion. Thus, the waste liquid flowing along the bottom face enters the third recess portion, thereby delaying waste liquid reaching the inside of the second recess portion.

Technical Idea 5: the waste liquid container according to any one of Technical Ideas 1 to 4, wherein the waste liquid container is detachably mounted on a mounting unit that has a waste liquid discharge outlet capable of being connected to the waste liquid inlet and a circuit board connector capable of being electrically coupled to the connection terminal along with a movement in a moving direction intersecting the width direction, and the recess portion extends along the moving direction.

With this configuration, even if the waste liquid that has leaked from the waste liquid inlet or the waste liquid discharge outlet flows in the moving direction when mounting/unmounting the waste liquid container, the recess portion that extends in the moving direction contains the waste liquid, thereby restraining the waste liquid from diffusing in the width direction.

Technical Idea 6: the waste liquid container according to any one of Technical Ideas 1 to 5, further including a dent, wherein when the side face is a first side face, the waste liquid vessel has a second side face that is an outer surface opposite to the first side face, and the dent opens in the mounting face and the second side face below the waste liquid inlet.

According to this configuration, a dent in which waste liquid can stay is provided at a position away from the first side face in which the connection terminal is disposed. This can reduce the amount of waste liquid flowing toward the first side face.

Technical Idea 7: the waste liquid container according to any one of Technical Ideas 1 to 6, wherein when the side face is a first side face, the waste liquid vessel includes a second side face that is an outer surface opposite to the first side face, a front face that is an outer surface opposite to the mounting face, and a chamfered face that is an outer surface formed such that an edge of the waste liquid vessel is chamfered, the chamfered face intersecting the bottom face, the first side face, the second side face, and the front face, and the waste liquid vessel also includes a grip disposed in the front face.

With this configuration, even if waste liquid flows along the bottom face to the front face, the waste liquid can stay in the space formed by chamfering an edge of the waste liquid vessel. As a result, waste liquid does not easily adhere to the grip.

Technical Idea 8: an attachment including a frame body having a mounting face, a side face, and a bottom face that are outer surfaces intersecting each other, a waste liquid inlet disposed on the mounting face, a circuit board having a connection terminal disposed along the side face, and a recess portion that opens in the mounting face and the bottom face below the waste liquid inlet, wherein when a width direction is defined as a direction in which both the mounting face and the bottom face extend, the recess portion is disposed at a position between the waste liquid inlet and the connection terminal in the width direction.

With this configuration, even if waste liquid that has leaked from the waste liquid inlet flows along the mounting face toward the bottom face, the waste liquid stays within the recess portion and does not easily flow toward the connection terminal. Thus, faulty connections due to waste liquid adhesion to the connection terminal does not tend to occur.

Technical Idea 9: the attachment according to Technical Idea 8, further including, when the recess portion is a first recess portion, a second recess portion that opens in the mounting face and the side face, wherein the circuit board is disposed inside the second recess portion.

According to this configuration, the second recess portion that accommodates the connection terminal does not open in the bottom face. As a result, the waste liquid that has flowed toward the bottom face does not easily enter the second recess portion. This reduces the likelihood of waste liquid adhering to the connection terminal disposed inside the second recess portion.

Technical Idea 10: the attachment according to Technical Idea 9, wherein the circuit board is disposed inside the second recess portion in such a manner that the connection terminal faces outward in the width direction.

According to this configuration, the connection terminal faces outward in the width direction so that waste liquid does not easily adhere to the connection terminal compared with the case in which the connection terminal faces toward the mounting face.

Technical Idea 11: the attachment according to Technical Idea 9 or 10, further including a third recess portion that opens in the mounting face and the side face below the second recess portion.

With this configuration, even if the waste liquid leaking from the waste liquid inlet or the waste liquid discharge outlet drips in the moving direction, the recess portion that extends in the moving direction contains the waste liquid, thereby restraining the waste liquid from diffusing in the width direction.

Technical Idea 12: the attachment according to any one of Technical Ideas 8 to 11, further comprising a dent, wherein when the side face is a first side face, the frame body has a second side face that is an outer surface opposite to the first side face, and the dent opens in the mounting face and the second side face below the waste liquid inlet.

According to this configuration, a dent in which waste liquid can stay is provided at a position away from the first side face in which the connection terminal is disposed. This can reduce the amount of waste liquid flowing toward the first side face.

The entire disclosure of Japanese Patent Application No. 2017-003965, filed Jan. 13, 2017 is expressly incorporated by reference herein.

What is claimed is:

1. A waste liquid container, comprising:

a body having a mounting face, a side face, and a bottom face that are outer surfaces intersecting each other;

a waste liquid inlet disposed on the mounting face;

a circuit board having a connection terminal disposed along the side face;

a recess portion that opens in the mounting face and the bottom face below the waste liquid inlet; and a dent, wherein when a width direction is defined as a direction in which both the mounting face and the bottom face extend, the recess portion is disposed at a position between the waste liquid inlet and the connection terminal in the width direction, and wherein when the side face is a first side face, the body has a second side face that is an outer surface opposite to the first side face, and the dent opens in the mounting face and the second side face below the waste liquid inlet.

2. The waste liquid container according to claim 1, further comprising, when the recess portion is a first recess portion, a second recess portion that opens in the mounting face and the side face, wherein the circuit board is disposed inside the second recess portion.

3. The waste liquid container according to claim 2, wherein the circuit board is disposed inside the second recess portion in such a manner that the connection terminal faces outward in the width direction.

4. The waste liquid container according to claim 2, further comprising a third recess portion that opens in the mounting face and the side face below the second recess portion.

5. The waste liquid container according to claim 1, wherein the waste liquid container is detachably mounted on a mounting unit that has a waste liquid discharge outlet capable of being connected to the waste liquid inlet and a circuit board connector capable of being electrically coupled to the connection terminal along with a movement in a moving direction intersecting the width direction, and the recess portion extends along the moving direction.

6. A liquid ejecting apparatus comprising:

a liquid ejecting head configured to eject liquid, and a mounting unit on which the waste liquid container according to claim 1 is detachably mounted, wherein the mounting unit includes a waste liquid outlet discharging a waste liquid and a projection to which a circuit board connector is joined.

7. A waste liquid container, comprising:

a body having a mounting face, a side face, and a bottom face that are outer surfaces intersecting each other;

a waste liquid inlet disposed on the mounting face;

a circuit board having a connection terminal disposed along the side face; and a recess portion that opens in the mounting face and the bottom face below the waste liquid inlet, wherein when a width direction is defined as a direction in which both the mounting face and the bottom face extend, the recess portion is disposed at a position between the waste liquid inlet and the connection terminal in the width direction, wherein when the side face is a first side face, the body includes:

a second side face that is an outer surface opposite to the first side face, a front face that is an outer surface opposite to the mounting face, and a chamfered face that is an outer surface formed such that an edge of the body is chamfered, the chamfered face intersecting the bottom face, the first side face, the second side face, and the front face, and the body also includes a grip disposed in the front face.

8. A liquid ejecting apparatus comprising:

a liquid ejecting head configured to eject liquid, and a mounting unit on which the waste liquid container according to claim 7 is detachably mounted, wherein the mounting unit includes a waste liquid outlet discharging a waste liquid and a projection to which a circuit board connector is joined.

9. An attachment comprising:

a frame body having a mounting face, a side face, and a bottom face that are outer surfaces intersecting each other;

a waste liquid inlet disposed on the mounting face;

a circuit board having a connection terminal along the side face;

a recess portion that opens in the mounting face and the bottom face below the waste liquid inlet; and a dent, wherein when a width direction is defined as a direction in which both the mounting face and the bottom face extend, the recess portion is disposed at a position between the waste liquid inlet and the connection terminal in the width direction, wherein when the side face is a first side face, the frame body has a second side face that is an outer surface opposite to the first side face, the dent opens in the mounting face and the second side face below the waste liquid inlet.

10. The attachment according to claim 9, further comprising, when the recess portion is a first recess portion, a second recess portion that opens in the mounting face and the side face, wherein the circuit board is disposed inside the second recess portion.

11. The attachment according to claim 10, wherein the circuit board is disposed inside the second recess portion in such a manner that the connection terminal faces outward in the width direction.

12. The attachment according to claim 10, further comprising a third recess portion that opens in the mounting face and the side face below the second recess portion.

13. A liquid ejecting apparatus comprising:

a liquid ejecting head configured to eject liquid, and a mounting unit on which the waste liquid container according to claim 9 is detachably mounted, wherein the mounting unit includes a waste liquid outlet discharging a waste liquid and a projection to which a circuit board connector is joined.

* * * * *